US009017240B2

(12) United States Patent
Diehr et al.

(10) Patent No.: US 9,017,240 B2
(45) Date of Patent: Apr. 28, 2015

(54) TRANSPORTING APPARATUS AND SHEET-PROCESSING MACHINE WITH A TRANSPORTING APPARATUS

(75) Inventors: Wolfgang Diehr, Grevenbroich (DE); Martin Mertens, Schriesheim (DE); Sedat Padar, Cologne (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 896 days.

(21) Appl. No.: 13/213,115

(22) Filed: Aug. 19, 2011

(65) Prior Publication Data

US 2012/0053035 A1 Mar. 1, 2012

(30) Foreign Application Priority Data

Aug. 31, 2010 (DE) ..... 10 2010 036 013

(51) Int. Cl.
*B31B 1/62* (2006.01)
*B65H 29/12* (2006.01)
*B65H 5/02* (2006.01)

(52) U.S. Cl.
CPC ..... *B65H 29/12* (2013.01); *B31B 2201/0247* (2013.01); *B65H 5/023* (2013.01); *B65H 2301/4474* (2013.01);
(Continued)

(58) Field of Classification Search
CPC ..... B65G 37/005; B65G 15/20; B65G 15/12; B65G 21/2054; B65G 13/11; B65G 21/14; B65G 47/522; B65G 47/5131; B65G 13/12; B65G 15/26; B65G 15/60; B65G 15/00; B65G 17/18; B65G 17/26; B65G 21/10; B65H 2220/04; B65H 2301/44732; B65H 2301/4474; B65H 2511/20; B65H 2404/741
USPC ..... 493/128, 56, 60, 65, 71, 365, 68, 477, 493/478; 53/259, 529, 371.5, 251; 198/812, 198/345.2, 313, 339.1, 341.08, 626.1, 198/626.3, 626.4; 271/3.18, 3.2, 3.14, 272, 271/198; 100/154; 156/555, 580; 83/479
See application file for complete search history.

(56) References Cited

U.S. PATENT DOCUMENTS 2,300,713 A * 11/1942 Staude ..... 493/278
3,758,366 A * 9/1973 Ballestrazzi et al. ..... 156/515
(Continued)

FOREIGN PATENT DOCUMENTS

DE 882 354 7/1953
DE 933 411 9/1955
(Continued)

OTHER PUBLICATIONS

German Patent and Trademark Office Search Report, Dated Apr. 11, 2011.

*Primary Examiner* — Stephen F Gerrity
*Assistant Examiner* — Joy N Sanders
(74) *Attorney, Agent, or Firm* — Laurence A. Greenberg; Werner H. Stemer; Ralph E. Locher

(57) ABSTRACT

A transporting apparatus for transporting flat, sheet-like material through one or more processing stations of a sheet-processing machine includes at least one upper conveying apparatus and at least one lower conveying apparatus with conveying devices which are in contact with one another. The upper and lower conveying apparatuses are fastened in such a way that they can be altered freely in length. A sheet-processing machine with a transporting apparatus is also provided.

13 Claims, 9 Drawing Sheets

(52) U.S. Cl.
CPC ..... *B65H 2404/2613* (2013.01); *B65H 2404/2614* (2013.01); *B65H 2404/2691* (2013.01); *B65H 2701/1764* (2013.01); *B65H 2801/21* (2013.01)

(56) References Cited

U.S. PATENT DOCUMENTS

| | | | | |
|---|---|---|---|---|
| 4,381,637 | A * | 5/1983 | Ballestrazzi et al. | 53/51 |
| 4,640,404 | A * | 2/1987 | Bigott | 193/35 TE |
| 4,709,537 | A * | 12/1987 | Ballestrazzi et al. | 53/550 |
| 5,046,603 | A | 9/1991 | Odenthal | |
| 5,282,528 | A | 2/1994 | Hudson | |
| 5,414,973 | A | 5/1995 | Müller | |
| 5,562,032 | A * | 10/1996 | Hasegawa et al. | 101/232 |
| 6,247,581 | B1 * | 6/2001 | Oswald et al. | 198/812 |
| 6,601,841 | B1 * | 8/2003 | Werner | 271/3.01 |
| 6,712,197 | B2 * | 3/2004 | Kubota et al. | 198/620 |
| 2004/0094391 | A1 * | 5/2004 | Schaum et al. | 198/812 |
| 2007/0039799 | A1 * | 2/2007 | Minchey | 193/35 R |
| 2008/0060916 | A1 * | 3/2008 | Whittlesey | 198/812 |
| 2009/0058000 | A1 | 3/2009 | Gnagi et al. | |

FOREIGN PATENT DOCUMENTS

| | | | |
|---|---|---|---|
| DE | 1 956 269 | | 5/1971 |
| DE | 39 03 820 | C2 | 2/1991 |
| DE | 41 23 446 | C1 | 12/1992 |
| DE | 200 06 995 | U1 | 7/2000 |
| DE | 10 2004 022 334 | A1 | 12/2005 |
| EP | 1 593 485 | A1 | 11/2005 |
| EP | 2172329 | A2 | 4/2010 |
| JP | 2004269177 | A | 9/2004 |
| JP | 2004338126 | A | 12/2004 |
| WO | 2004/043834 | A1 | 5/2004 |

* cited by examiner

TRANSPORTING APPARATUS AND SHEET-PROCESSING MACHINE WITH A TRANSPORTING APPARATUS

CROSS-REFERENCE TO RELATED APPLICATION

This application claims the priority, under 35 U.S.C. §119, of German Patent Application DE 10 2010 036 013.9, filed Aug. 31, 2010; the prior application is herewith incorporated by reference in its entirety.

BACKGROUND OF THE INVENTION

Field of the Invention

The invention relates to a transporting apparatus for transporting flat, sheet-like material made of paper or cardboard or the like, in particular printed or non-printed sheets, folding-box blanks or folding boxes, through one or more processing stations of a sheet-processing machine. The transporting apparatus includes at least one upper conveying apparatus and at least one lower conveying apparatus. The at least one upper conveying apparatus has a rolling-rail panel, a rolling-rail bar fastened on the rolling-rail panel, a plurality of resiliently fastened conveying rollers, further deflecting rollers and a conveying device guided around the conveying rollers and around the further deflecting rollers. The at least one lower conveying apparatus has a roller sideplate, a bar, a plurality of conveying rollers fastened on the bar, further deflecting rollers and a conveying device guided around the conveying rollers and around the further deflecting rollers. The conveying devices are in contact with one another. A drive is connected to the at least one upper and/or the at least one lower conveying apparatus. The invention also relates to a sheet-processing machine with a transporting apparatus.

For the purpose of producing high-quality printed products for the packaging industry, for example folding boxes, sheets are printed in wide-web form in a printing machine in a first instance. In each case a number of copies of the folding box which is to be produced are printed on the sheets, and those copies are then punched out in a punching device. The punched-out folding-box blanks are subsequently fed to a folding-box adhesive-bonding machine and processed there to form folding boxes.

Folding-box adhesive-bonding machines for producing folding boxes from folding-box blanks are known to have at least the following modules as processing stations:

a feeder, through the use of which the blanks which are to be processed are withdrawn one after the other from a stack, and fed individually to the following, first processing station, at high speed, a unit for applying adhesive, usually glue, through the use of which an adhesive strip is applied to the folding flaps which are to be adhesively bonded, a folding station, in which the blank parts provided with an adhesive-bonding strip are folded over through 180° to produce an adhesive-bonding connection, the folding station is usually followed by a so-called transfer station, in which the boxes can be counted, marked and, if defective, ejected.

that is followed by a pressing station, at the start of which is formed an imbricated stream of folded blanks, and that imbricated stream is retained under pressure for some time in the pressing station in order for the two blanks to be connected at the adhesive-bonding seam.

The individual processing stations have driven conveying devices for transporting the folding-box blanks. Those conveying devices include, for example, a respective upper and lower conveying belt disposed on the side of the machine, wherein the lower conveying belt is guided in a roller sideplate and the upper conveying belt is guided in a rolling rail. The conveying belts are disposed in a transversely adjustable manner and can thus be set to the respective folding-box-blank format. The blanks are transported between the upper and lower conveying belts with the printed side downward.

Such a folding-box adhesive-bonding machine is disclosed in German Published Patent Application DE 10 2004 022 344 A1, corresponding to European Patent Application EP 1 593 485 A1.

However, there are application cases in which the continuous lower conveying belts are disadvantageous because, for example, a line camera is to be used to record an image over the entire printed blank width for monitoring purposes or the folding-box blank is to undergo additional processing, for example the embossing of Braille script or scoring or punching. In order to create a gap for those processing/monitoring operations, the upper conveying apparatus and/or the lower conveying apparatus are divided. Different gaps have to be created for the various applications. For production-related reasons, however, the aim is to keep the gap as small as possible, in order to ensure that the box blank can be transported reliably.

SUMMARY OF THE INVENTION

It is accordingly an object of the invention to provide a transporting apparatus and a sheet-processing machine with a transporting apparatus, which overcome the hereinaforementioned disadvantages of the heretofore-known apparatuses and machines of this general type and in which the transporting apparatus has transporting gaps that can be configured in a variable manner.

With the foregoing and other objects in view there is provided, in accordance with the invention, a transporting apparatus for transporting flat, sheet-like material made of paper, cardboard or the like, in particular printed or non-printed sheets, folding-box blanks or folding boxes, through one or more processing stations of a sheet-processing machine. In a preferred embodiment, the transporting apparatus according to the invention comprises at least one upper conveying apparatus and one lower conveying apparatus. The upper conveying apparatus in this case has a rolling rail, with a plurality of resiliently fastened conveying rollers, and a conveying device, which is guided around these conveying rollers and further deflecting rollers. The lower conveying apparatus has a roller sideplate, with a plurality of conveying rollers fastened on a bar, and a conveying device, which is guided around these conveying rollers and further deflecting rollers. The upper and lower conveying devices in each case are in contact with one another and clamp between them the sheet-like material which is to be transported. For the purpose of transporting the sheet-like material, at least one of the upper and/or lower conveying apparatuses is connected to a drive. According to the invention, the rolling-rail bars and the bar fastened on the roller sideplate are fastened on the rolling-rail panel and the roller sideplate in such a way that they can be altered freely in length.

It is, of course, also possible for the transporting apparatus to include just one upper conveying apparatus or just one lower conveying apparatus, and these conveying apparatuses can be telescopically pushed apart from one another, and pushed together, in order to create interspaces for tools and the like. In order for the sheet-like material to be guided reliably, these conveying apparatuses may be configured, for example, as suction belts.

In accordance with another feature of the invention, the rolling-rail bar and the bars fastened on the roller sideplate have filler pieces for the purpose of altering the length of the transporting path. For the purpose of adapting the length of the conveying device to the respective length of the transporting path, the conveying devices are additionally guided around deflecting rollers, which are fastened in an adjustable manner on the rolling-rail panel and the roller sideplate.

In accordance with a further feature of the invention, the conveying devices are configured as transporting belts. This provides for a particularly straightforward and cost-effective configuration.

In accordance with an added feature of the invention, the additional deflecting rollers are fastened in a displaceable manner in grooves of the rolling-rail panel and of the roller sideplate. This allows particularly straightforward adaptation of the length of the conveying devices to the length of the transporting path.

In accordance with an additional feature of the invention, the transporting apparatus has two upper conveying apparatuses and one lower conveying apparatus. This makes it possible for a tool to be positioned between the two upper conveying apparatuses. As an alternative, it is also possible for the transporting apparatus to have one upper conveying apparatus and two lower conveying apparatuses, as a result of which a tool can be positioned between the two lower conveying apparatuses. As a further alternative, it is possible for the transporting apparatus to have two upper conveying apparatuses and two lower conveying apparatuses. This has the advantage of creating space for a tool which is disposed, in part, above and, in part, beneath the transporting path, for example a rotary stamping or embossing device.

With the objects of the invention in view, there is concomitantly provided a sheet-processing machine, comprising a transporting apparatus having at least one upper and/or at least one lower conveying apparatus each being configured to be freely altered in length.

Such a transporting apparatus can be used particularly advantageously in a printing machine or a further-processing machine, e.g. in a folding-box adhesive-bonding machine.

Other features which are considered as characteristic for the invention are set forth in the appended claims.

Although the invention is illustrated and described herein as embodied in a transporting apparatus and a sheet-processing machine with a transporting apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
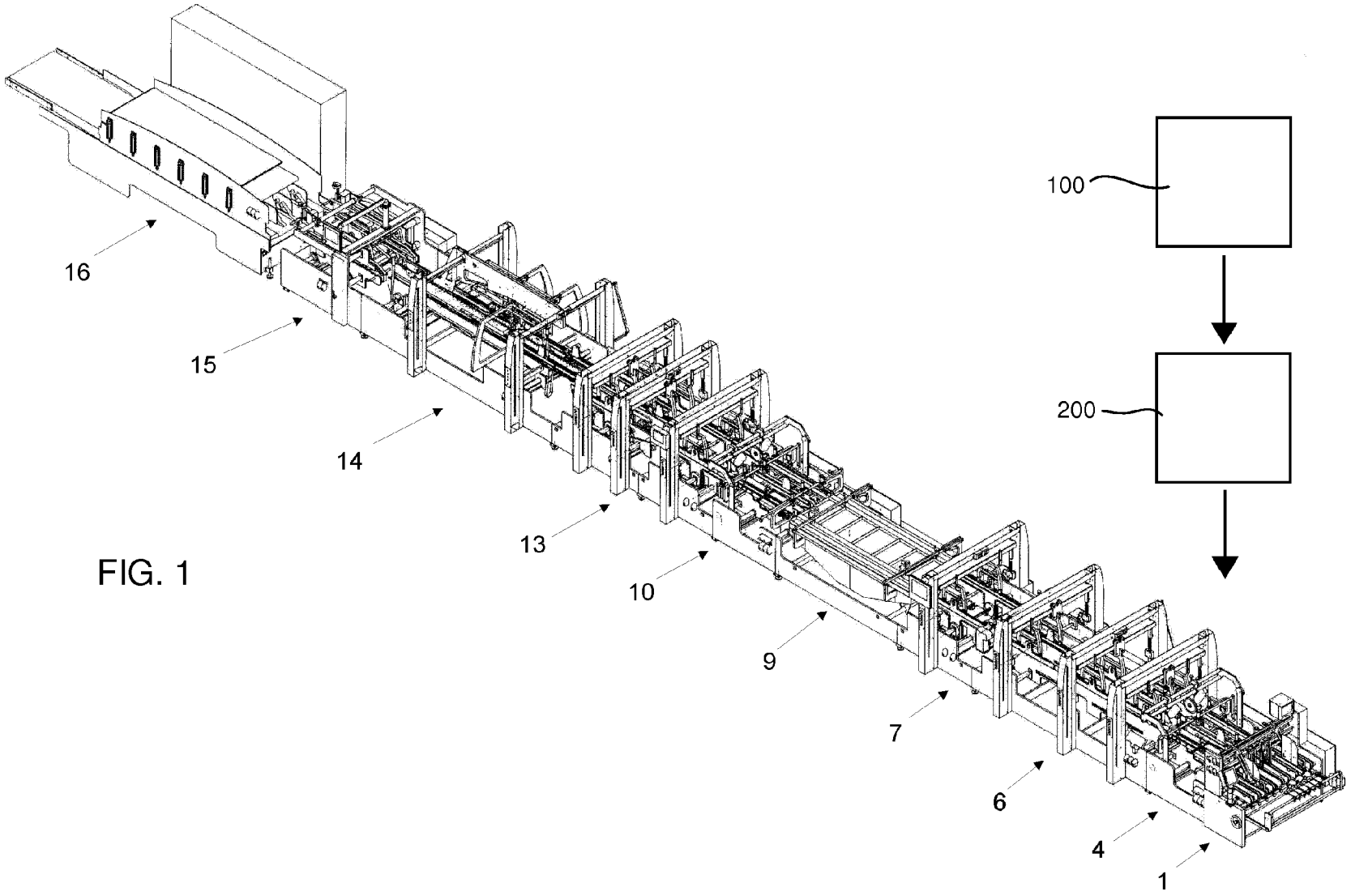
FIG. 1 is a diagrammatic, perspective view of an example of individual processing stations of a folding-box adhesive-bonding machine.

Referring now to the figures of the drawings in detail and first, particularly, to FIG. 1 thereof, there is seen, as an example of a further-processing machine of a printing machine 100, the example of the further-processing machine is a folding-box adhesive-bonding machine with a number of processing stations, in which the transporting apparatus according to the invention can be used. A punching device 200 is also provided for punching out the sheets The folding-box adhesive-bonding machine begins at the bottom right of FIG. 1 with a feeder 1, through the use of which blanks which are to be processed are withdrawn one after the other from a stack, and fed individually to a following processing station, at high speed. The feeder 1 is followed by an aligning station 4, in which the blanks are aligned individually against a lateral stop. Leading through the aligning station are transversely positionable machine components in the form of two pairs of belts which serve as conveying devices and can be positioned transversely through actuating drives.

A pre-breaker 6 and a first folding module 7 then follow. Leading both through the pre-breaker 6 and through the folding module 7 are transversely positionable machine components in the form of pairs of belts as conveying devices which can be positioned transversely by an actuating drive in dependence on the type of blank.

The folding module 7 is followed by a rotating station 9. The rotating station 9, for the purpose of rotating the blanks through 90° about a vertical axis, contains two conveying portions which are disposed parallel one beside the other and the speeds of which can be set separately. The blanks rest on both conveying portions, and they are therefore rotated at different speeds of the two conveying portions. The two conveying portions contain driven rollers as conveying devices.

The rotating station 9 is followed by a further aligning station 10, which corresponds, in terms of construction, to the aligning station downstream of the feeder 1. It thus contains, in turn, transversely positionable machine components in the form of pairs of conveying belts as conveying devices.

The next processing station 13 serves to carry out processing operations in dependence on the type of box. For example, further scoring lines are pre-broken or special folding is carried out. Also leading through the processing station 13 are pairs of belts as conveying elements which can be positioned transversely by actuating drives.

The processing station 13 is then followed by a folding station 14, in which blank parts previously provided with an adhesive-bonding seam are folded over through 180°. The folding station 14 contains pairs of belts as conveying elements, and also contains an adhesive-application unit, and these can be moved through the use of actuating drives into their transverse position in dependence on the type of blank. The folding station 14 is then followed by a transfer station 15, through the use of which the folded blanks provided with not-yet-set adhesive-bonding seams are fed, with all parts aligned precisely, to a following collecting and pressing device 16. In the collecting and pressing device 16, in the first instance an imbricated stream of folded blanks is formed, and this imbricated stream is then retained under pressure for some time between conveying pressing bands in order for the adhesive-bonding seams to set. The transfer station likewise contains pairs of belts which can be adjusted transversely through the use of actuating drives.

Figure 2:
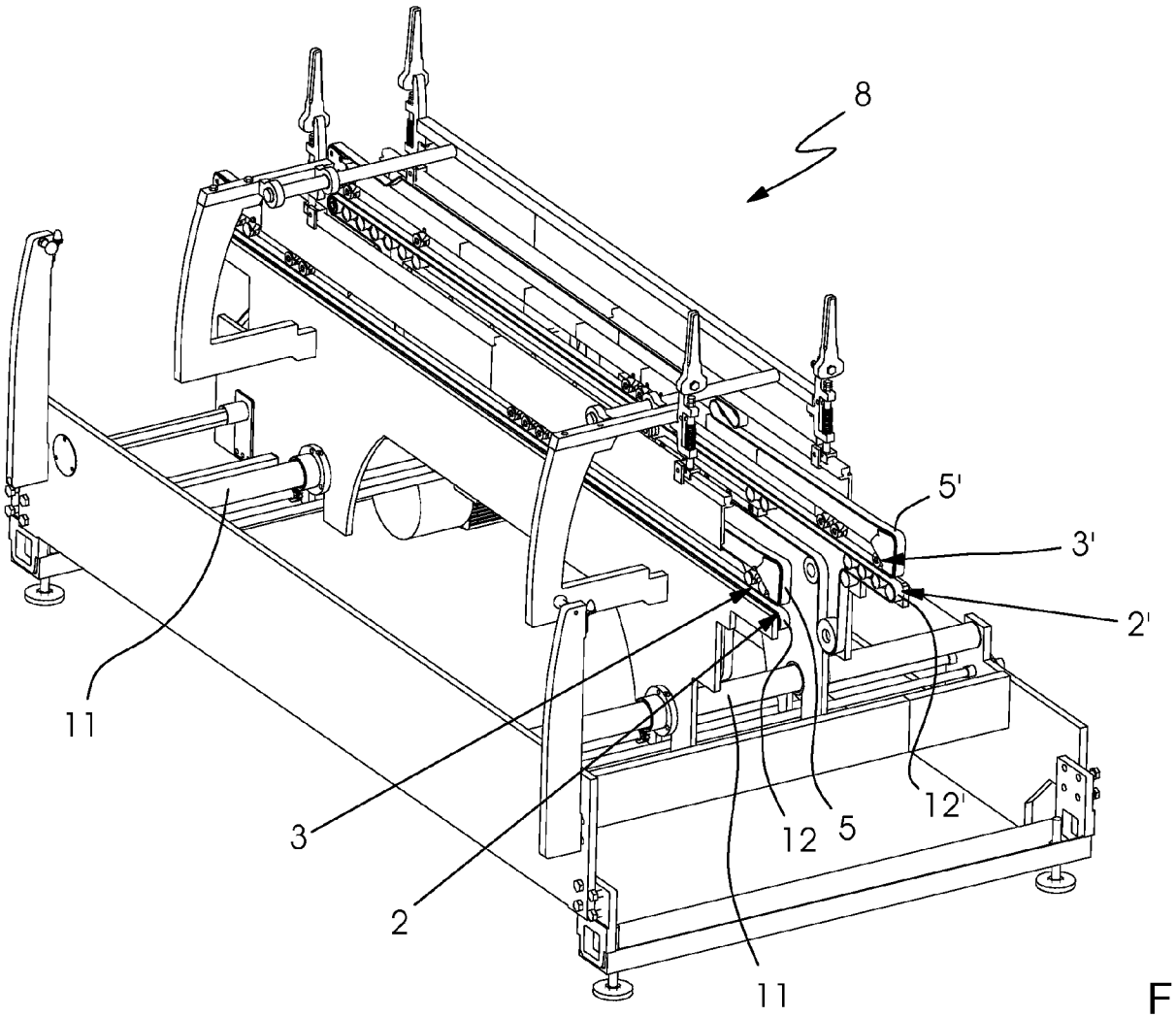
FIG. 2 PRIOR ART
FIG. 2 is a perspective view of a continuous prior-art transporting apparatus in a processing station of a folding-box adhesive-bonding machine.

FIG. 2 shows an example of a prior-art transporting apparatus 8 with an upper conveying apparatus 3, 3' on the left and right in each case, and with a lower conveying apparatus 2, 2' on the left and right in each case. Those conveying apparatuses are constructed, in the present example, as belt conveyors with corresponding conveying belts as conveying devices 5, 5', 12, 12'. The conveying apparatuses 3, 3', 2, 2' are mounted on round crossmembers 11, and they can therefore be set to the respective box-blank width.

The diagrammatic illustrations which are described below each illustrate just one upper conveying apparatus and one lower conveying apparatus, for the sake of clarity.

Figure 3:
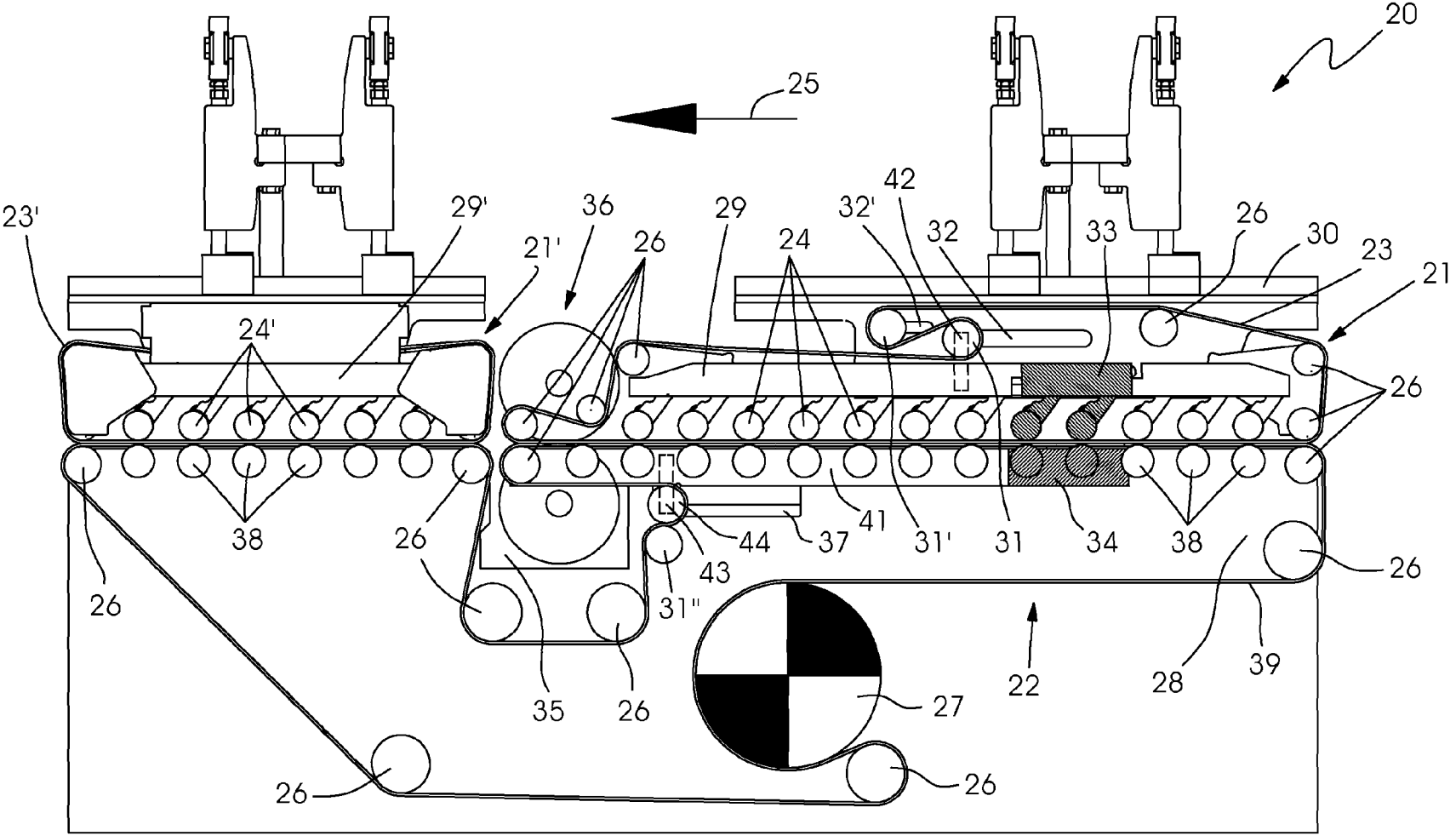
FIG. 3 is a side-elevational view of a transporting apparatus according to the invention.

FIG. 3 illustrates a transporting apparatus 20 according to the invention. The transporting apparatus 20, in the present exemplary embodiment, has two upper conveying apparatuses 21, 21' and one lower conveying apparatus 22. The first upper conveying apparatus 21, as seen in a conveying direction 25, has a rolling-rail bar 29, on which a plurality of conveying rollers 24 are fastened in a resilient manner. A conveying device 23, for example in the form of an endless conveying belt, is guided around these conveying rollers 24 and further deflecting rollers 26, 31, 31'. The second upper conveying apparatus 21', as seen in the conveying direction 25, has a rolling-rail bar 29', on which a plurality of conveying rollers 24' are fastened in a resilient manner. A conveying device 23', for example in the form of an endless conveying belt, is guided around these conveying rollers 24' and further non-illustrated deflecting rollers. The two upper conveying apparatuses are spaced apart from one another by a variable distance b, b' (as is evident from FIGS. 6A-6B).

The lower conveying apparatus 22 has a plurality of conveying rollers 38, which are fastened on a roller sideplate 28 by a bar 41. A conveying device 39, for example in the form of an endless conveying belt, is guided around these conveying rollers 38 and further deflecting rollers 26, 27, 44, 31". In the specific embodiment, the lower conveying device 39 is guided, by the deflecting rollers 26, around a gap 35 in the roller sideplate 28. A tool 36 for processing the folding-box blanks, for example a rotating stamping or embossing device, is fitted in this gap, between the conveying apparatuses 21, 21', 22. Since different tools require different amounts of space, one or more filler pieces 33, 34 may be fastened in a releasable manner in the rolling-rail bar 29 and/or the bar 41. These filler pieces serve to assist the conveying belt 23, 39 in the case of the different distances b, b' between the upper and/or lower conveying apparatuses 21, 21', 22, 22'. The rollers 31', 31" are constructed as tensioning rollers. The tensioning roller 31' is fastened in a displaceable manner in a groove 32' of the rolling-rail panel, in order to subject the conveying device 23 to the necessary tensioning. The tensioning roller 31" is fixed to the roller sideplate 28. The deflecting roller 31 is fixed to the rolling-rail bar 29 by a holder 42. If the rolling-rail bar is connected in a releasable manner to a rolling-rail panel 30 at a predetermined spacing therefrom and if, then, the rolling-rail bar 29 is connected to the rolling-rail panel 30 at a different position within the spacing, then the deflecting roller 31 moves in the groove 32 and thus ensures that the transporting length of the conveying device 23 does not alter and there is therefore no need for any retensioning of the conveying device.

The lower conveying apparatus 22 is adjusted in an analogous manner. The deflecting roller 44 is fixed to the bar 41 by a holder 43. The bar 41 is connected in a releasable manner to the roller sideplate 28 at a predetermined spacing therefrom. If, then, the bar 41 is connected to the roller sideplate 28 at another position within the spacing, then the deflecting roller 44 moves in a groove 37 of the roller sideplate 28 and thus ensures that the transporting length of the conveying device 23 does not alter. This makes it easy to set different distances b, b' between the conveying apparatuses. For stabilizing purposes, the lower pieces 33 and 34 can be inserted into the gaps which arise in the rolling-rail bar 29, on one hand, and in the bar 41, on the other hand.

Figure 4:
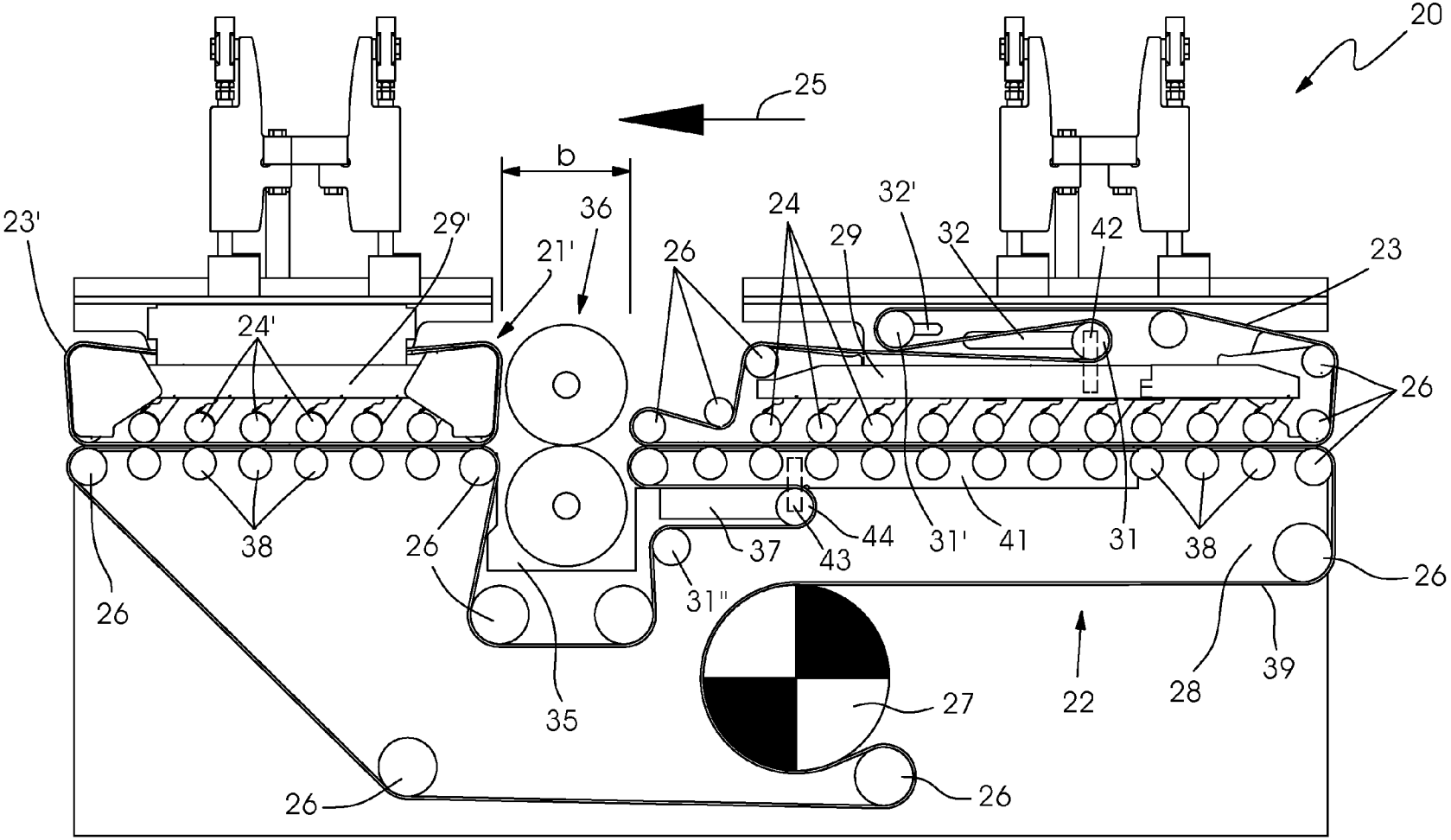
FIG. 4 is a side-elevational view of the transporting apparatus according to the invention without any filler pieces.

FIG. 4 illustrates the transporting apparatus with an enlarged distance b'. The filler pieces 33, 34 have been removed and the deflecting rollers 31 and 44 have been displaced correspondingly in the grooves 32 and 37.

In the exemplary embodiments according to FIGS. 3 and 4, in each case the lower deflecting roller 26 is connected to a non-illustrated drive and thus serves as a driven deflecting roller 27. This embodiment, however, is only shown by way of example. It is, of course, also possible to use other deflecting rollers as driven deflecting rollers.

Figure 5:
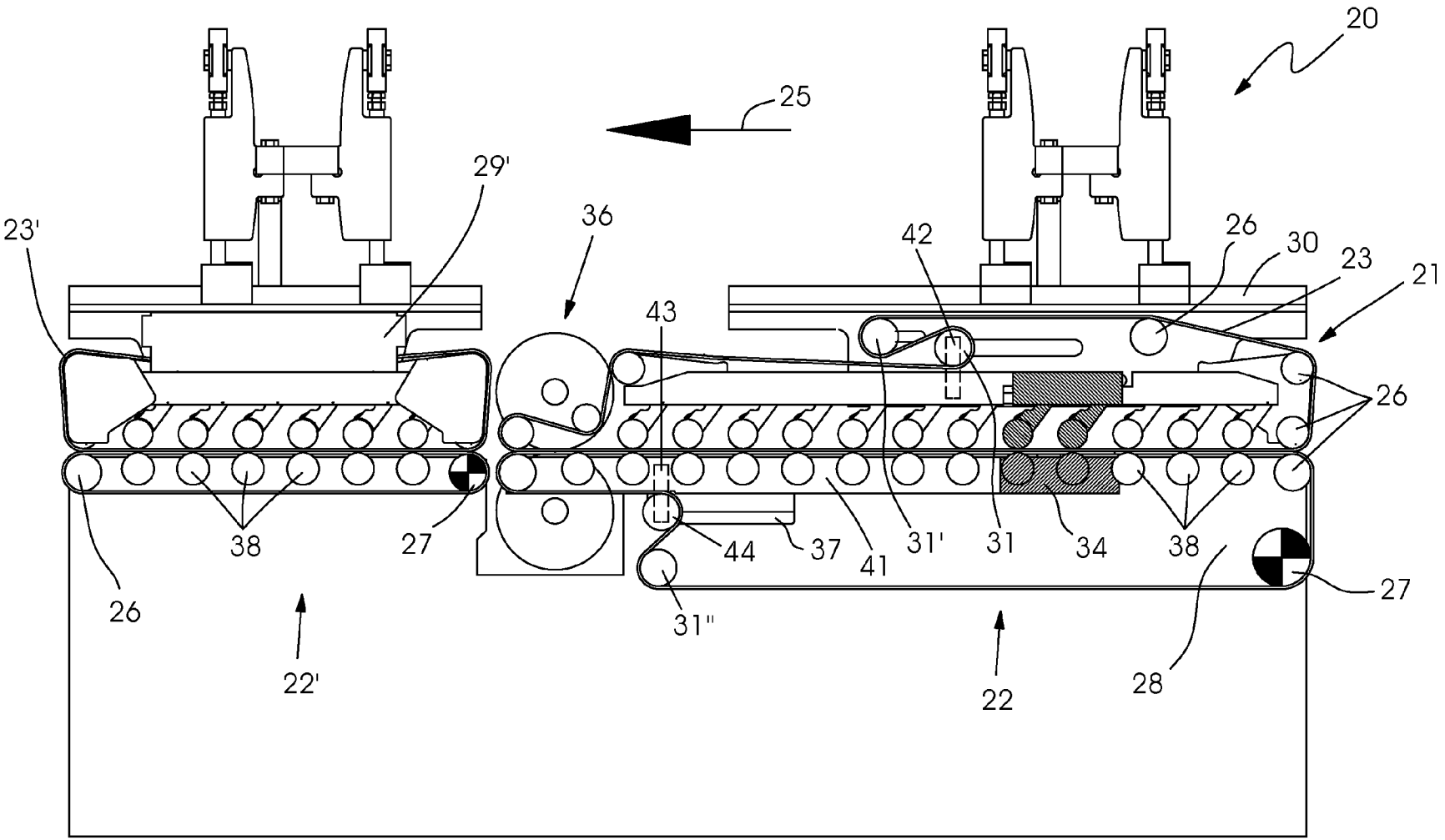
FIG. 5 is a side-elevational view of an alternative transporting apparatus according to the invention.

FIG. 5 illustrates an alternative transporting apparatus 20 according to the invention. In contrast to the embodiment according to FIG. 3, the present embodiment also has a two-part lower conveying apparatus 22, 22'. In the case of this variant, in each case the two right-hand deflecting rollers 26 of the lower conveying apparatuses 22, 22' are connected to a non-illustrated drive and are thus configured as driven deflecting rollers 27.

Figure 6A:
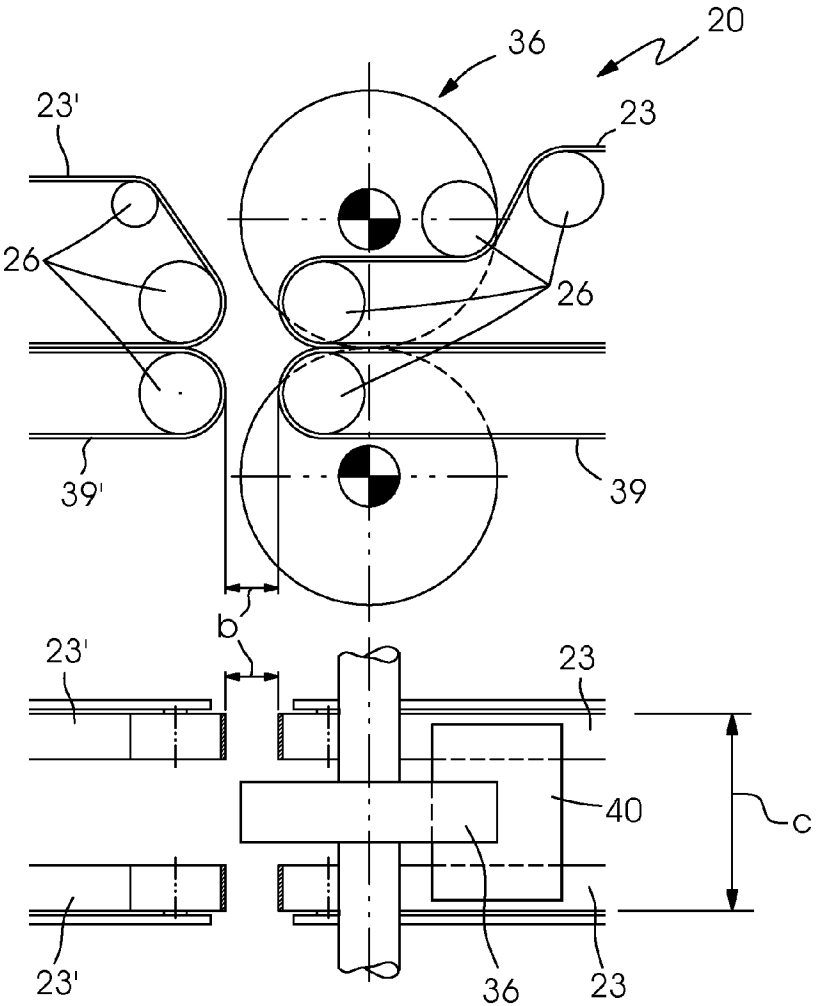
FIGS. 6A-6C each include fragmentary, side-elevational and top-plan views illustrating a number of different settings of conveying apparatuses of a transporting apparatus according to the invention.
Figure 6B:
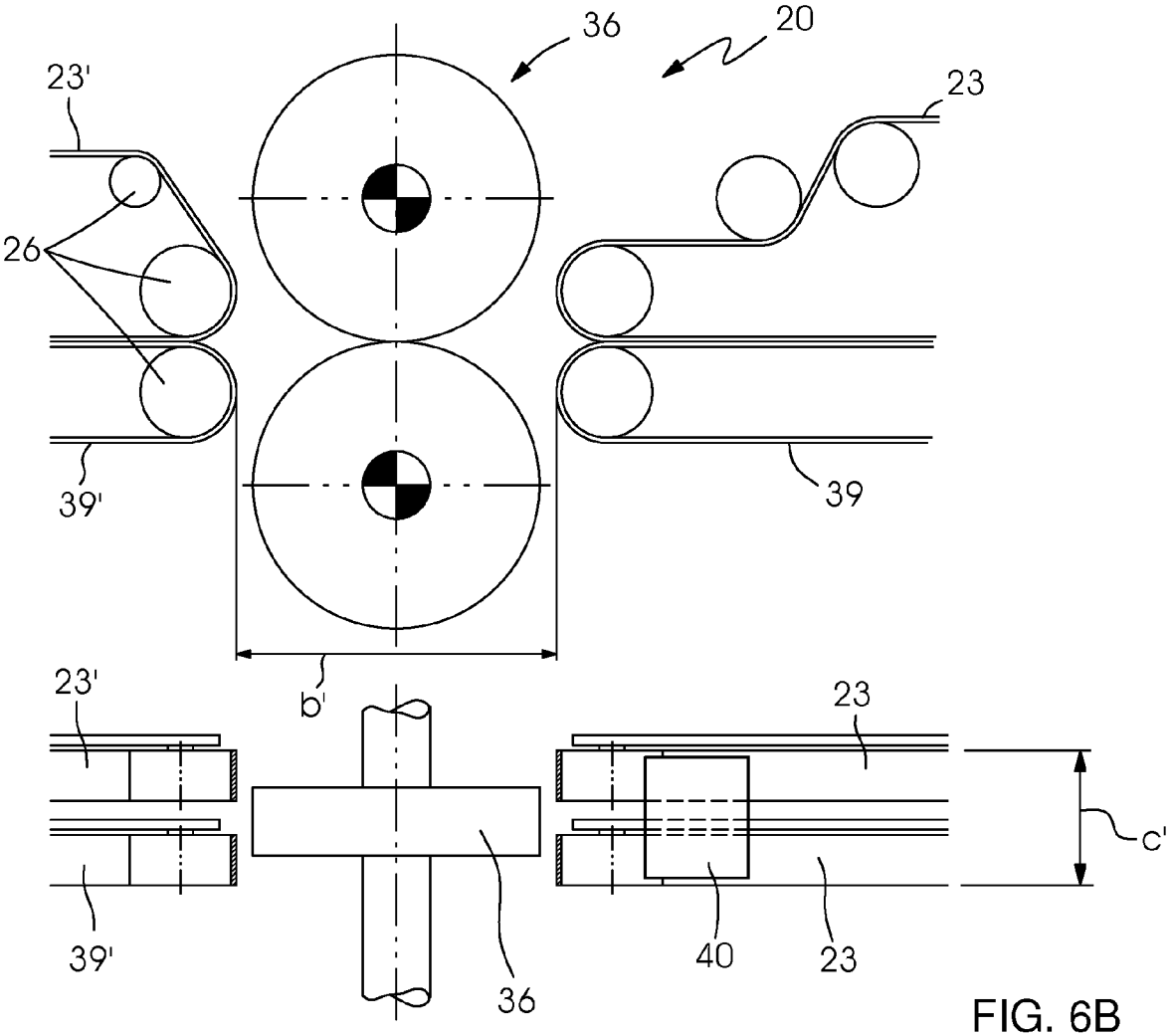

FIGS. 6A-6B each illustrate, in a diagrammatic side view and plan view, different possible settings which can be realized by using the transporting apparatus according to the invention. FIG. 6A shows the transporting apparatus 20 for transporting sheet-like material 40 of blank width c. Since the tool 36 for processing the sheet-like material 40, for example a box blank, is fitted between the front and rear conveying apparatuses 21, 21', 22, 22', the conveying apparatuses can be set to the minimum distance b from one another with or without the filler pieces 33, 34 being used.

FIG. 6B shows the transporting apparatus 20 for transporting sheet-like material 40 of blank width c'. In order for it to be possible for the tool 36 for processing the sheet-like material, for example a box blank, to be fitted between the front and rear conveying apparatuses 21, 21', 22, 22', these conveying apparatuses have to be guided apart from one another to a distance b'. For this purpose, the corresponding filler pieces 33, 34, if present, are removed, as illustrated in FIG. 4.

Figure 6C:
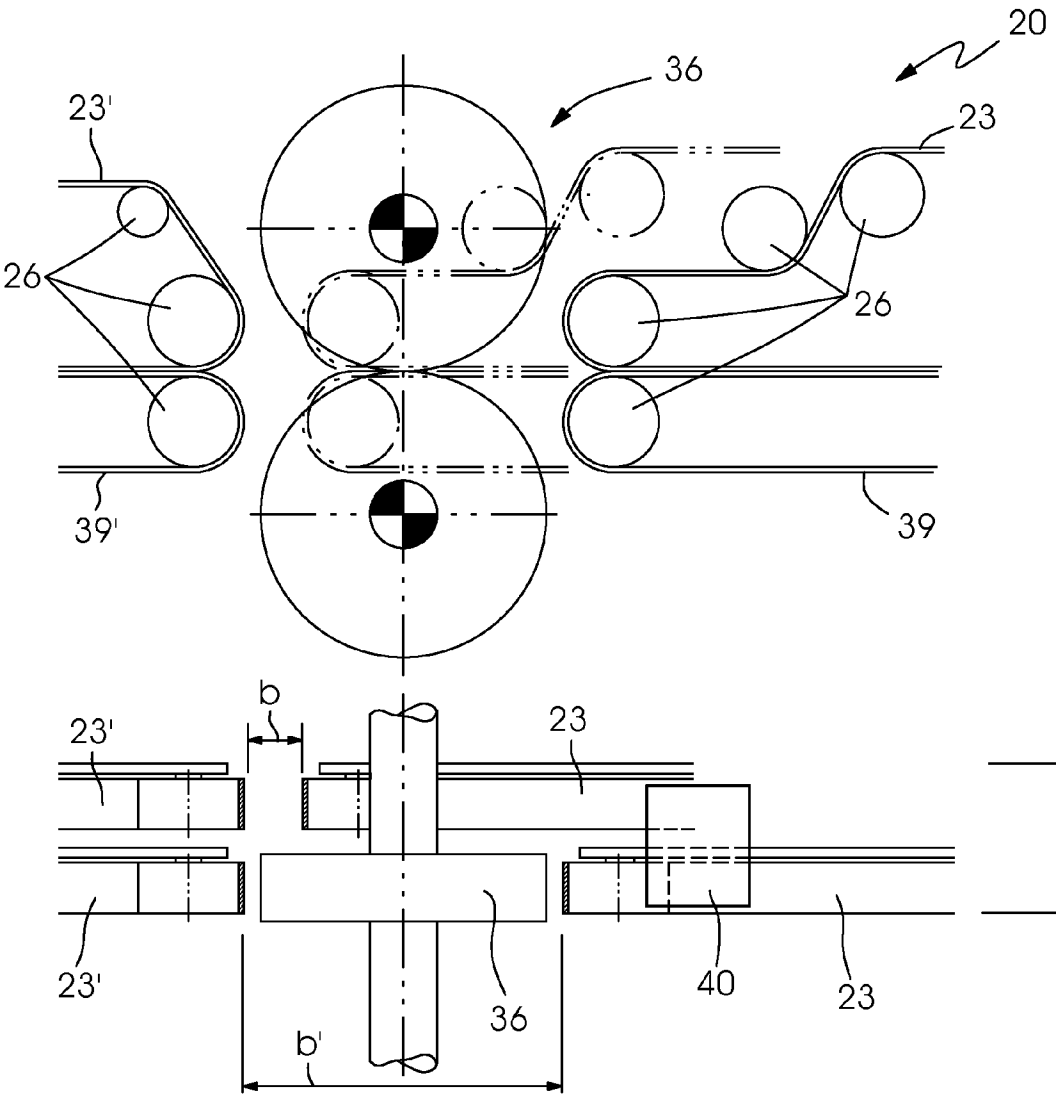

FIG. 6C shows the transporting apparatus 20 for transporting sheet-like material 40 of blank width c'. Since processing with the tool 36 is to take place in the lower region of the sheet, only the front conveying apparatuses are set to the distance b', while the rear conveying apparatuses are set to the distance b.

Figure 7:
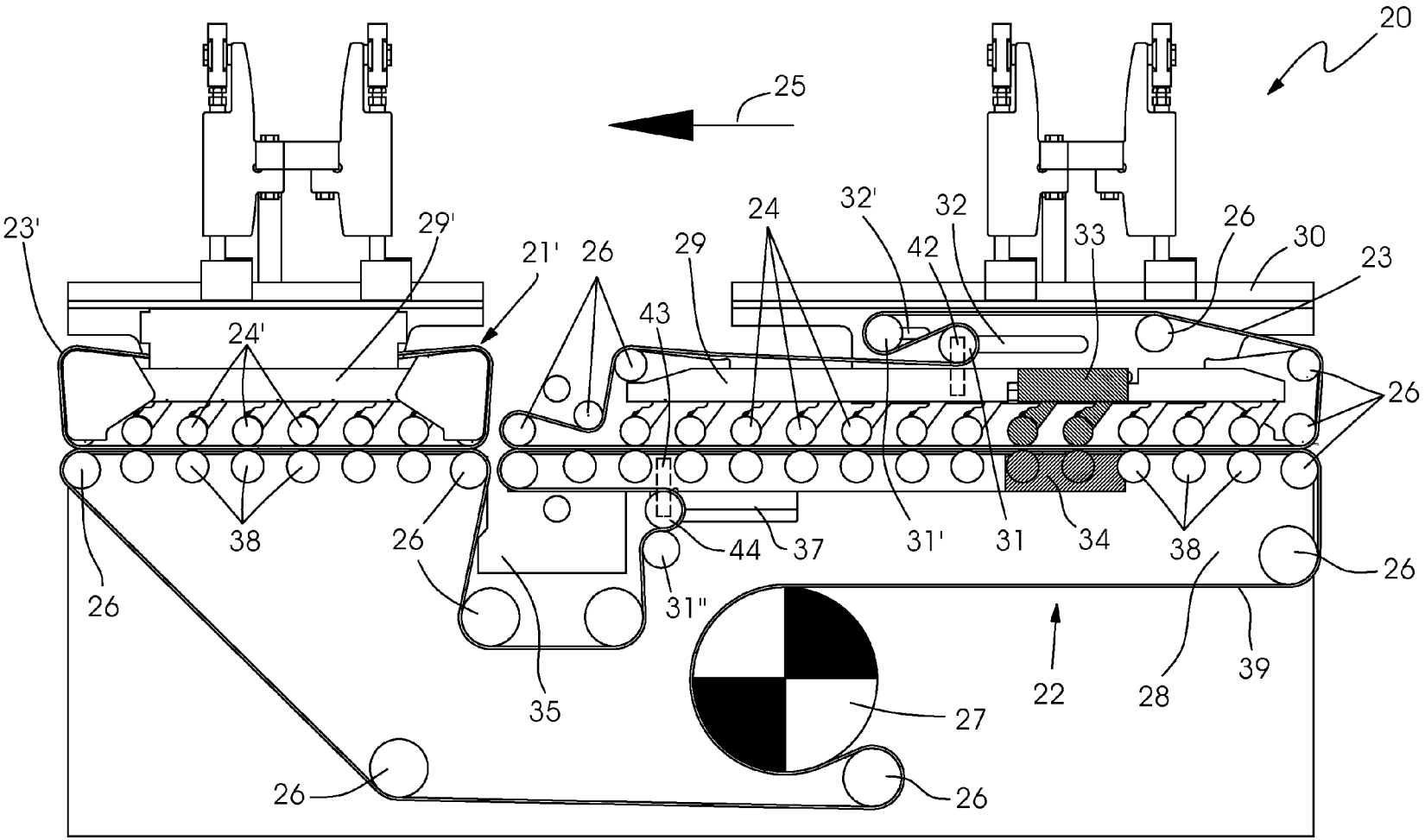
FIG. 7 is a side-elevational view of the transporting apparatus according to the invention without any tool.

FIG. 7 shows a further embodiment of the transporting apparatus according to the invention. This embodiment corresponds to that of FIG. 3 but without any tool, for which reason the distance b between the conveying apparatuses can be restricted to a minimum.

The invention claimed is:

1. A transporting apparatus for transporting flat, sheet-shaped material made of paper or cardboard or printed or non-printed sheets, folding-box blanks or folding boxes, through one or more processing stations of a sheet-processing machine, the transporting apparatus comprising:

at least one upper conveying apparatus and at least one lower conveying apparatus;

said at least one upper conveying apparatus having a rolling-rail panel, a rolling-rail bar, a plurality of resiliently fastened conveying rollers fastened to said rolling-rail bar, further deflecting rollers and a conveying device guided around said conveying rollers and around said further deflecting rollers, said rolling-rail bar being fastened on said rolling-rail panel in a configuration permitting free alterations of said rolling-rail bar in length;

said at least one lower conveying apparatus having a roller sideplate, a bar, a plurality of conveying rollers fastened on said bar, further deflecting rollers and a conveying device guided around said conveying rollers and around said further deflecting rollers, said bar being fastened on said roller sideplate in a configuration permitting free alterations of said bar in length;

said conveying devices being in contact with one another; and a drive connected to at least one of said at least one upper or said at least one lower conveying apparatuses.

2. The transporting apparatus according to claim 1, which further comprises:

filler pieces of said rolling-rail bar and said bar fastened on said roller sideplate for altering a length of a transporting path; and additional deflecting rollers each being adjustably fastened on a respective one of said rolling-rail panel and said roller sideplate;

said conveying devices being guided around said additional deflecting rollers for adapting a length of said conveying devices to a respective length of said transporting path.

3. The transporting apparatus according to claim 2, wherein said additional deflecting rollers are displaceably fastened in grooves respectively formed in said rolling-rail panel and said roller sideplate.

4. The transporting apparatus according to claim 1, wherein said conveying devices are configured as transporting belts.

5. The transporting apparatus according to claim 1, wherein said at least one upper conveying apparatus and said at least one lower conveying apparatus are two upper conveying apparatuses and one lower conveying apparatus.

6. The transporting apparatus according to claim 1, wherein said at least one upper conveying apparatus and said at least one lower conveying apparatus are two upper conveying apparatuses and two lower conveying apparatuses.

7. The transporting apparatus according to claim 1, wherein:

said at least one upper conveying apparatus and said at least one lower conveying apparatus define a gap therebetween; and a tool is disposed in said gap for processing the sheet-shaped material.

8. The transporting apparatus according to claim 7, wherein said tool for processing the sheet-shaped material is a stamping apparatus or a Braille embosser or a scoring device or a cutting device.

9. A sheet-processing machine, comprising:

a transporting apparatus according to claim 1.

10. The sheet-processing machine according to claim 9, wherein the sheet-processing machine is a printing machine or a further-processing machine.

11. The sheet-processing machine according to claim 10, wherein the further-processing machine is a folding-box adhesive-bonding machine.

12. The transporting apparatus according to claim 1, further comprising a holder fixed on said rolling-rail bar, a tensioning roller being fixed on said holder for displacing said tensioning roller during the alterations in length of said rolling-rail bar.

13. A transporting apparatus for transporting flat, sheet-shaped material made of paper or cardboard or printed or non-printed sheets, folding-box blanks or folding boxes, through one or more processing stations of a sheet-processing machine, the transporting apparatus comprising:

at least one upper conveying apparatus and at least one lower conveying apparatus;

said at least one upper conveying apparatus having a rolling-rail panel, a rolling-rail bar, a plurality of resiliently fastened conveying rollers fastened to said rolling-rail bar, further deflecting rollers and a conveying device guided around said conveying rollers and around said further deflecting rollers, said rolling-rail bar being fastened on said rolling-rail panel in a configuration permitting free alterations of said rolling-rail bar in length;

said at least one lower conveying apparatus having a roller sideplate, a bar, a plurality of conveying rollers fastened on said bar, further deflecting rollers and a conveying device guided around said conveying rollers and around said further deflecting rollers, said bar being fastened on said roller sideplate in a configuration permitting free alterations of said bar in length;

said conveying devices being in contact with one another;

a drive connected to at least one of said at least one upper or said at least one lower conveying apparatuses;

said at least one upper conveying apparatus and said at least one lower conveying apparatus define a gap therebetween; and apparatuses are disposed in said gap for monitoring the sheet-shaped material.

* * * * *